US006180298B1

(12) United States Patent
Kuroda et al.

(10) Patent No.: US 6,180,298 B1
(45) Date of Patent: Jan. 30, 2001

(54) MULTI-COLOR TONER SET AND METHOD OF FORMING MULTI-COLOR IMAGES, USING THE MULTI-COLOR TONER SET

(75) Inventors: Noboru Kuroda; Kohsuke Suzuki; Yohichiroh Watanabe; Keiko Shiraishi, all of Shizuoka (JP)

(73) Assignee: Ricoh Company, Ltd., Tokyo (JP)

( * ) Notice: Under 35 U.S.C. 154(b), the term of this patent shall be extended for 0 days.

(21) Appl. No.: 09/292,840

(22) Filed: Apr. 16, 1999

(30) Foreign Application Priority Data

Apr. 17, 1998 (JP) ..... 10-122709

(51) Int. Cl.[7] ..... G03G 9/097
(52) U.S. Cl. ..... 430/45; 430/111
(58) Field of Search ..... 430/45, 106, 116, 430/111

(56) References Cited

U.S. PATENT DOCUMENTS

| | | | |
|---|---|---|---|
| 4,814,253 | 3/1989 | Gruber et al. | 430/106.6 |
| 4,908,290 | 3/1990 | Watanabe et al. | 430/106.6 |
| 4,956,258 | 9/1990 | Watanabe et al. | 430/109 |
| 5,176,978 | 1/1993 | Kumashiro et al. | 430/110 |
| 5,288,577 | 2/1994 | Yamaguchi et al. | 430/106.6 |
| 5,368,972 | 11/1994 | Yamashita et al. | 430/137 |
| 5,429,901 | 7/1995 | Muto et al. | 430/110 |
| 5,474,871 | 12/1995 | Takagi et al. | 430/110 |
| 5,486,445 | 1/1996 | Van Dusen et al. | 430/110 |
| 5,798,200 * | 8/1998 | Matsuura et al. | 430/98 |
| 5,998,074 * | 12/1999 | Miyamoto et al. | 430/111 |

FOREIGN PATENT DOCUMENTS

| | | |
|---|---|---|
| 0 595 642 | 5/1994 | (EP) . |
| 0 743 564 | 11/1996 | (EP) . |
| 0 822 458 | 2/1998 | (EP) . |
| 2 016 725 | 9/1979 | (GB) . |
| 2 222 268 | 2/1990 | (GB) . |
| 2 280 039 | 1/1995 | (GB) . |

OTHER PUBLICATIONS

Patent Abstracts of Japan, vol. 1995, No. 1, Feb. 28, 1995, JP 6–289645, Oct. 18, 1994.

* cited by examiner

*Primary Examiner*—John Goodrow
(74) *Attorney, Agent, or Firm*—Oblon, Spivak, McClelland, Maier & Neustadt, P.C.

(57) ABSTRACT

A multi-color toner set includes a plurality of color toners with different colors, each color toner including toner particles, each toner particle including a binder resin, a pigment and a releasing agent, at least part of the releasing agent being present in the form of domains in the binder resin, with a difference between a maximum content and a minimum content of the releasing agent in the form of domains in the binder resin in each of the color toners being in a range of 20% or less. Multi-color images can be formed, using this multi-color toner set.

23 Claims, 2 Drawing Sheets

YELLOW TONER

MAGENTA TONER

CYAN TONER

BLACK TONER

YELLOW TONER

MAGENTA TONER

CYAN TONER

BLACK TONER

MULTI-COLOR TONER SET AND METHOD OF FORMING MULTI-COLOR IMAGES, USING THE MULTI-COLOR TONER SET

BACKGROUND OF THE INVENTION

1. Field of the Invention

The present invention relates to a multi-color toner set comprising a plurality of color toners for developing latent electrostatic images to form multi-color images, with the attainment of substantially the same hot offset initiation temperature, durability, and image transfer performance thereof with respect to each color toner in the multi-color toner set. These color toners for the multi-color toner set can be produced by a conventional fusing and kneading method and a conventional pulverizing method.

The present invention also relates to a method of forming multi-color images, using the multi-color toner set.

2. Discussion of Background

In electrophotography, a latent electrostatic image is formed on a photoconductor comprising a photoconductive material, using various means, and the formed electrostatic image is then developed with a toner to a visible toner image, and when necessary, the developed visible toner image is then transferred to a sheet of paper, and fixed thereto with the application of heat and/or pressure thereto, or using a vapor of a solvent, whereby a hard copy can be obtained.

As methods for developing the electrostatic image to the visible image, using the toner, there are known, for instance, magnetic brush development method, cascade development method, and powder cloud development method. In any of these development methods, the step of fixing the toner image to a transfer sheet is a very important step. In particular, when the toner image is thermally fixed, using heat rollers, the toner image in a fused state comes into contact with the surface of the heat rollers, so that a phenomenon that the toner image adheres to the surface of the heat rollers and is transferred thereto, that is, a so-called offset phenomenon, may take place. However, the occurrence of such offset phenomenon should be prevented.

Conventionally, in order to prevent the occurrence of the offset phenomenon, the surface of an image fixing roller is made of a material having excellent releasability with respect to the toner, such as silicone rubber or fluorine-based resin.

Furthermore, conventionally, in order to prevent the occurrence of the offset phenomenon more effectively, and also to prevent the fatigue of the surface of the image fixing roller, the surface of the image fixing roller is covered or coated with a thin layer of a liquid which has high releasability with respect to the toner, such as silicone oil or a fluorine-based oil, which may be referred to as the offset preventing liquid.

The above-mentioned method is extremely effective for preventing the occurrence of the offset phenomenon, but has a problem that an apparatus for supplying the offset preventing liquid to the image fixing roller is required, which makes the image fixing apparatus complicated in mechanism. Furthermore, the step of coating the surface of the image fixing roller with the oil has the risk of bringing about the problems that the surface layers of the image fixing roller are separated and accordingly the life of the image fixing roller is significantly shortened while in use.

Instead of using such an oil supplying apparatus, there has been proposed a method of supplying an offset preventing liquid from toner particles themselves in the course of the image fixing step with the application of heat and/or pressure. More specifically, a releasing agent such as low-molecular-weight polyethylene, or low-molecular-weight polypropylene, is added to the toner particles and is caused to ooze from the toner particles at the image fixing step while heat and/or pressure is applied thereto.

By the above-mentioned method, the occurrence of the offset phenomenon can be in fact prevented at the image fixing step when heat and/or pressure is applied. However, it has been found that the releasing agent is released from the toner particles and adheres to the surface of carrier particles or a charging member, so that a so-called spent phenomenon takes place by which the charging performance of the carrier particles and the charging member is significantly lowered, as a result, the durability of the toner or the developer is markedly lowered.

It is also known that the presence of the above-mentioned releasing agent within the toner impairs the fluidity of the toner or the transfer performance of the toner to a transfer sheet.

In order to prevent the toner particles from becoming a film on a development sleeve and/or on a photoconductor, and also to prevent the occurrence of the spent phenomenon on the carrier and the deposition of the toner on a blade, the following proposals have been made so as to control the state of the toner itself and also the state of the releasing agent in the toner: For example, in Japanese Laid-Open Patent Application 3-243956, there is proposed the use of a toner having a 200 to 5000 Å average lattice length of a primary peak of a small angle X-ray scattering (SAXS); in Japanese Laid-Open Patent Application 3-296067, there is proposed a toner at a cross section of which there are formed island-sea structures composed of a binder polymer and polypropylene, with a maximum diameter in a major axis of island portions formed by the polypropylene being in a range of 200 to 3000 Å, and an average interval among the islands being 1 $\mu$m or less; and in Japanese Laid-Open Patent Application 5-45925, there is proposed a toner comprising toner particles on the surface of which there is deposited a releasing agent with a particle size of 100 to 500 Å, having a fusing initiation temperature—fusing termination temperature difference of 50° C. or less, and a melting point of 60 to 180° C.

In order to maintain the development performance and abrasion resistance of a photoconductor, there is proposed in Japanese Laid-Open Patent Application 5-197199 a toner on the surface of which there are dispersed polyolefin particles with a particle size of 0.01 to 0.5 $\mu$m in an amount of 2 to 20%; in Japanese Laid-Open Patent Application 7-301951 a toner comprising a binder resin and a releasing agent with an SP value difference thereof being 1.5 or less; and in Japanese Laid-Open Patent Application 7-271095 a toner comprising a releasing agent with a crystallization degree in a range of 40 to 60% when the releasing agent is in the toner.

The above proposed toners have excellent spent phenomenon prevention effect and improved durability when used alone. However, these toners have a significant shortcoming that when used as a set of a plurality of color toners, properties such as hot offset initiation temperature, durability, and image transfer performance thereof differ in each color toner.

SUMMARY OF THE INVENTION

It is therefore a first object of the present invention to provide a multi-color toner set, with each color toner having improved durability and image transfer performance, with a minimized difference in the durability, image transfer performance and hot offset initiation temperature between each of the color toners.

A second object of the present invention is to provide a method of forming a multi-color image, with each color having improved durability and image transfer performance with a minimized difference in durability, image transfer performance and hot offset initiation temperature between each of the colors in the multi-color image.

The first object of the present invention can be achieved by a multi-color toner set comprising a plurality of color toners with different colors, each color toner comprising toner particles, each toner particle comprising a binder resin, a pigment and a releasing agent, at least part of the releasing agent being present in the form of domains in the binder resin, with a difference between a maximum content and a minimum content of the releasing agent in the form of domains in the binder resin in each of the color toners being in a range of 20% or less.

The second object of the present invention can be achieved by forming a multi-color image, using the above-mentioned multi-color toner set.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

As mentioned above, in the conventional toners, when used as a set of a plurality of color toners, the properties such as hot offset initiation temperature, durability, and image transfer performance thereof differ in each color toner.

The inventors of the present invention have discovered that the differences in the above-mentioned properties are caused, depending upon the state of the presence of a releasing agent in each color toner, more particularly, depending upon the state of the presence of the releasing agent in the form of domains in a binder agent used in the color toner. The domain here means a particular island-shaped portion where the releasing agent is present in the binder resin in a state different from the surrounding state thereof with the formation of an interface between the releasing agent and the binder resin.

In other words, the inventors of the present invention have discovered that a plurality of color toners which has the same or substantially the same above-mentioned properties can be obtained by controlling the state of the presence of the releasing agent in the form of domains in the binder resin.

Figure 1:
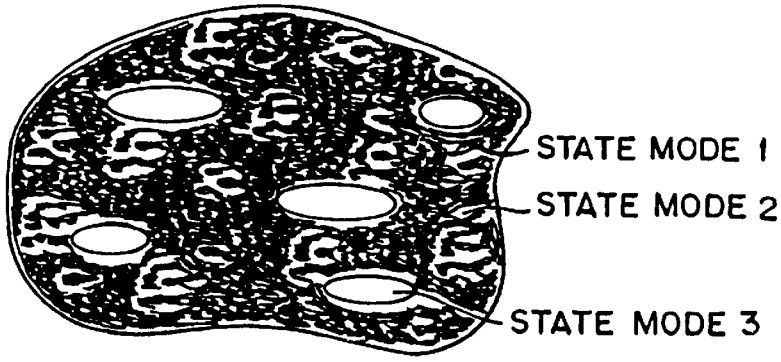
FIG. 1 is a schematic cross-sectional view of a toner observed by a transmission type electron microscope.
Figure 2A:
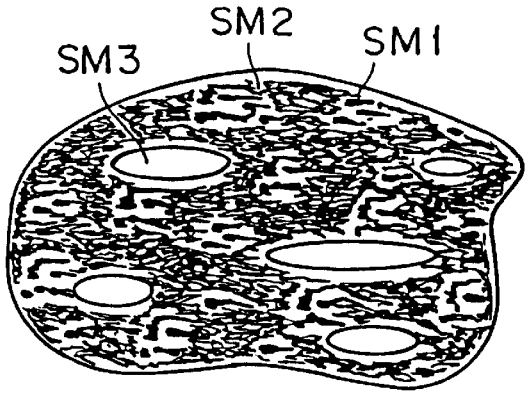
FIG. 2 is a schematic cross-sectional view of each of conventional toners observed by a transmission type electron microscope.
Figure 2B:
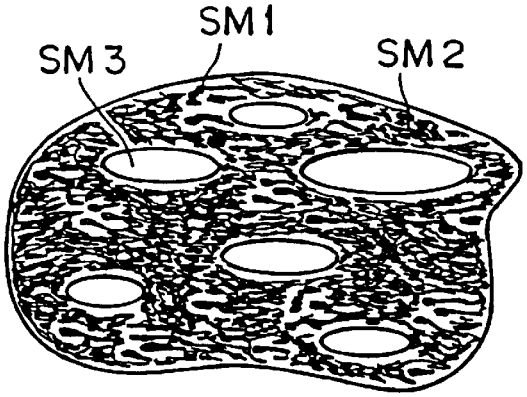
Figure 2C:
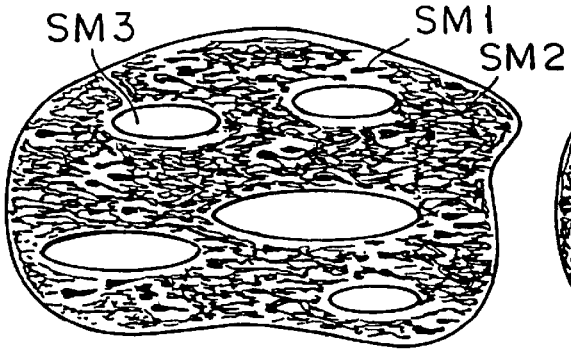
Figure 2D:
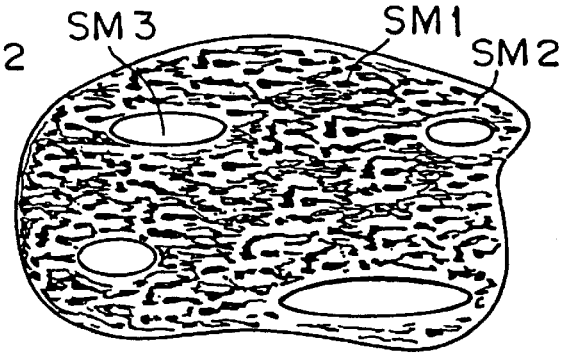
Figure 3A:
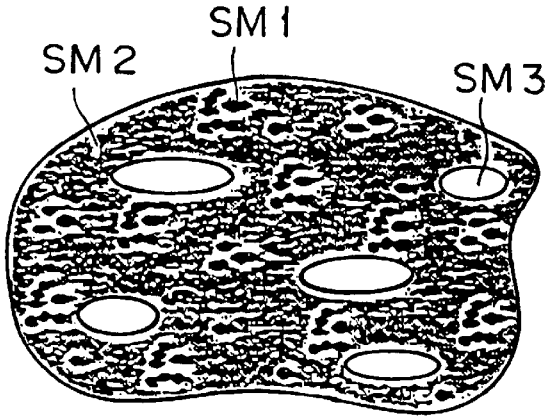
FIG. 3 is a schematic cross-sectional view of each of color toners of the present invention observed by a transmission type electron microscope.
Figure 3B:
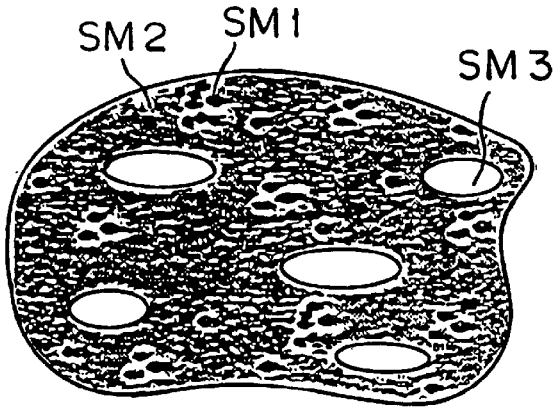
Figure 3C:
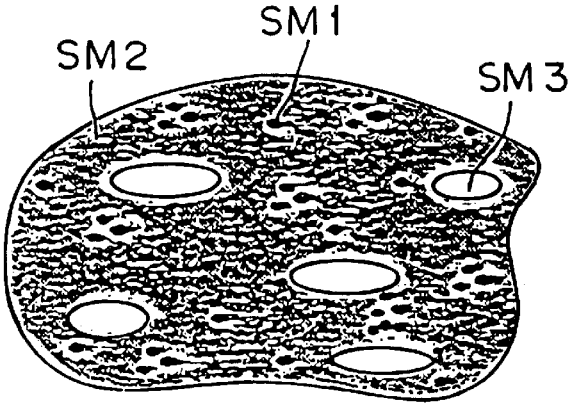
Figure 3D:
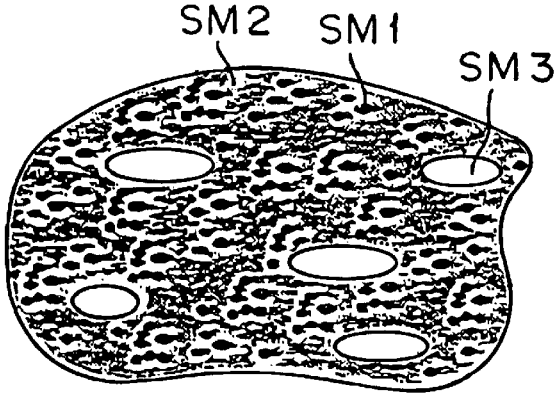

With reference to FIG. 1, the reason why a plurality of color toners which has the same or substantially the same above-mentioned properties can be obtained by controlling the state of the presence of the releasing agent in the form of domains in the binder resin will now be explained.

As illustrated in FIG. 1, the releasing agent is considered to be present in the toner in the following three State Modes 1, 2 and 3:

In State Mode 1, the releasing agent is present in such a state as absorbed by solid materials such as a pigment and a charge controlling agent.

In State Mode 2, the releasing agent is dispersed in the binder resin in a compatible state therewith at a molecular level.

In State Mode 3, the releasing agent is present in the form of island-shaped domains in the binder resin with the formation of interfaces between the releasing agent domains and the binder resin.

The difference between State Mode 1 and State Mode 2 cannot be recognized by a transmission type electron microscope, but the releasing agent, which is present in the form of domains in State Mode 3 can be easily identified by the transmission type electron microscope.

The hot offset initiation temperature is largely controlled by the releasing agent present in the form of domains in State Mode 3. It is considered that the releasing agent in State Mode 1 and the releasing agent in State Mode 2 have substantially no function of controlling the hot offset initiation temperature.

When a plurality of different color toners is used, the amount and the kind of the pigments used in each of the color toners differ, so that the amount of the releasing agent in State Mode 1 and that in State Mode 2 differ in each color toner and as a result, the amount of the releasing agent in Mode 3 differs in each color toner.

The pigments used in the color toners are mostly present in an aggregate form of particles with a particle diameter in the order of nano meter, that is, in the form of primary particles at a submicron level, so that a large amount of the releasing agent is absorbed by the pigments. This increases the difference in the amount of the releasing agent in State Mode 3 in each color toner.

For example, even when color toners are prepared using the same releasing agent with the same formulation under the same preparation procedure, the state of the presence of the releasing agent in each of the resultant color toners differs as illustrated in FIG. 2. In FIG. 2, SM1 denotes the releasing agent in State Mode 1; SM2, the releasing agent in State Mode 2; and SM3, the releasing agent in State Mode 3. As illustrated in FIG. 2, even though the color toners are prepared using the same releasing agent with the same formulation under the same preparation procedure as in a conventional method, the ratio of the total of the cross section areas of the releasing agent in SM3 to the corresponding cross section of each color toner, and the particle diameters of the dispersed releasing agent in the cross section in SM3 differ in each of the color toner as observed by the transmission type electron microscope.

Furthermore, the releasing agent in SM3 has an effect not only on the durability of the color toner, but also on the transfer performance thereof, so that a different amount of the releasing agent in SM3 in each color toner will result in that each color toner has a different durability and a different transfer performance. As a matter of course, the formation of a multi-color image, using a set of such color toners that have a different durability and a different transfer performance will lead to the formation of poor quality multi-color images.

Therefore, when the releasing agent is used in a set of a plurality of color toners, it is required that the formulation of the releasing agent be determined, with the amount of the releasing agent that could be used in SM1 and SM2 taken into consideration, and that a variation in the amount of the releasing agent that would be present in SM3 be minimized as illustrated in FIG. 3.

The inventors of the present invention discovered that a dispersion in anti-hot-offset performance can be minimized when using a multi-color toner set comprising a plurality of color toners with different colors, each color toner comprising toner particles, each toner particle comprising a binder resin, a pigment and a releasing agent, at least part of the releasing agent being present in the form of domains in the binder resin, with a difference between a maximum content and a minimum content of the releasing agent in the form of domains in the binder resin in each of the color toners being in a range of 20% or less, preferably 15% or less, more preferably 10% or less, for example, when calculating the ratio of the difference based on an average content of the releasing agent in the form of domains in the binder resin in the plurality of the color toners.

The content of the releasing agent in the form of domains in the binder resin in each toner particle can be determined at a predetermined cross section of the toner particle, for example, by measuring a ratio of a total area of the cross sections of the domains at the predetermined cross section of the toner particle to the cross section of the toner particle.

More specifically, the content of the releasing agent present in the form of domains in the binder resin for each color toner can be determined by dispersing the color toner in a solvent in which the binder resin is soluble, but the releasing agent is insoluble, for example, THF, and then by measuring an area ratio of the releasing agent in the cross section of the toner in an undried state, using a transmission type electron microscrope.

The difference between a maximum content and a minimum content of the releasing agent in the form of domains in the binder resin in each of the color toners, as calculated based on an average content of the releasing agent in the form of domains in the binder resin in the color toners, will be hereinafter referred to as "the domain releasing content variation" in the present specification.

When "the domain releasing content variation" exceeds 20%, each color toner comes to have a different a different anti-hot-offset performance. The 20% domain releasing content variation means that the content of the releasing agent in each color toner is within ±10% with respect to the average content of the releasing agent in each color toner.

It is preferable that a plurality of the color toners that is to be fixed simultaneously have the same image fixing characteristics. Therefore, when such a plurality of the color toners is prepared, the materials and the formulation thereof for each color toner are usually the same other than the pigment for each color toner. However, when the charging performance of each pigment for each color toner differs, the kind of the charge control agent will be appropriately selected and the amount thereof will also be adjusted so as to obtain the same charging performance for each color toner. Even when each color toner is thus prepared, it may occur that each color toner has a different hot offset initiation temperature. This is due to a different state of the releasing agent in each color toner, which controls and determines the hot offset initiation temperature.

According to the present invention, the hot offset initiation temperature of each color toner can be controlled so as to be substantially the same, and an image fixing effective temperature range of each color toner can be significantly broadened by controlling the amount of the releasing agent in each of the color toners so as to be in a range of 2 to 10 wt. % of the entire weight of each of the color toners, and by controlling a ratio of a total content of the releasing agent which is present in the form of domains in the binder resin in SM3 so as to be in a range of 2 to 7%, preferably in a range of 3 to 6%, more preferably in a range of 3 to 4%, in each of the color toners, for example, by measuring a ratio of a total area of the cross sections of the domains at a predetermined cross section of the toner particle to the cross section of the toner particle, using a transmission type electron microscope.

When the ratio of the total content of the releasing agent in SM3 is less than 2%, the hot offset phenomenon is difficult to prevent in a high temperature range even though the releasing agent is used for preventing the hot offset phenomenon, while when the ratio of the total content of the releasing agent in SM3 is more than 7%, the aggregation degree and the image transfer performance of the color toner are apt to be lowered due to the excessive amount of the releasing agent in the color toner. Furthermore, the spent phenomenon is also apt to occur and accordingly the durability of the developer tends to be lowered.

Furthermore, the durability of each color toner can be significantly improved by formulating the multi-color toner set of the present invention in such a manner that at least 75% of a total number of the domains of the releasing agent which is in State Mode 3 in the binder resin in each particle of the color toners has a maximum length of 1 $\mu$m or less.

When the maximum length exceeds 1 $\mu$m, the same adverse effects as caused by the use of the excessive amount of the releasing agent in the color toner, as mentioned above, are caused.

The maximum length can be measured by dispersing and/or dissolving each color toner, for instance, in a THF solvent at an appropriate concentration and inspecting the state of the releasing agent in an undried state, using an optical microscope.

The releasing agent for use in the multi-color toner set of the present invention may comprises at least two kinds of releasing agents, for instance, a first releasing agent with a melting point T1 and a second releasing agent with a melting point T2 which is lower than said melting point T1 of the first releasing agent. in this case, it is preferable that in releasing agent which is present in the form of domains in the binder resin, that is, in State Mode 3, the amount of the first releasing agent be greater than that of the second releasing agent. This is because the higher the melting point of the releasing agent, the greater the pulverizing degree of the releasing agent to obtain a small particle size releasing agent; and the smaller the particle size, the greater the durability of the releasing agent.

As the releasing agent for use in the present invention, it is preferable to employ, for example, low-molecular-weight polypropylene, low-molecular-weight polyethylene, and carnauba wax. Furthermore, there can be employed natural waxes such as candelilla wax, rice wax, and montan wax; low-molecular-weight polyolefin; higher fatty acids such as stearic acid, palmitic acid, and myristic acid; metal salts of higher fatty acid; and higher fatty acid amides.

The content of the releasing agent in the form of domains in the binder resin in SM3, and the dispersed particle diameter of the releasing agent can be controlled not only by adjusting the formulation and amount of the releasing agent to be added to the color toners, but also by adding to the color toners finely-divided particles which are incompatible with the binder resin in each of the particles of said color toners. By adding an appropriate amount of such finely-divided particles to the color toners, the content of the releasing agent in SM3 can be controlled.

The color toners for use in the present invention can be produced by a conventional method of mixing the above-mentioned components and then kneading and fusing the mixture in a kneader. However, it is preferable to produce the color toners by a method comprising the steps of having part of the releasing agent absorbed by the pigment or finely-divided metallic oxide particles subjected to hydrophobic treatment, and then kneading the remaining releasing agent and the binder resin together in order to efficiently produce the color toners for use in the present invention. In any event, it is preferable to have the releasing agent absorbed by any of the above-mentioned solid materials so as to be in State Mode 1 or 2 in advance, in order to produce the color toners for use in the present invention with high productivity, so as to have a minimum difference in the content of the releasing agent in the form of domains in the binder resin between each of the color toners.

Examples of the above-mentioned finely-divided particles with the above-mentioned properties are various kinds of finely-divided particles of metal oxides, finely-divided particles of ceramics, and finely-divided particles of metals. It is preferable that such finely-divided particles be colorless or white in order not to have any adverse effects on the hue and transparency of the color toners, and have a primary particle size of 0.1 $\mu$m or less.

Specific examples of the materials for the above-mentioned finely-divided particles of metal oxides are oxides of Si, Ti, Al, Mg, Ca, Sr, Ba, In, Ga, Ni, Mn, W, Fe, Co, Zn, Cr, Mo, Cu, Ag, V, and Zr, and composite oxides thereof.

Specific examples of the materials for the finely-divided particles of ceramics are SiC, $Si_3N_4$, TiC, TiN and WC. Of these finely-divided particles of metallic oxides and ceramics, finely-divided particles of silicon dioxide, titanium dioxide and alumina are more preferably employed.

The following are representative examples of agents for subjecting the finely-divided particles of the metallic oxides to hydrophobic treatment for effectively improving the oil absorption of the finely-divided particles of the metallic oxides: dimethyl dichlorosilane, trimehtylchlorosilane, methyl trichlorosilane, allyl dimethyl dichlorosilane, allyl phenyl dichlorosilane, benzyl dimethyl chlorosilane, bromomethyl dimethyl chlorosilane, α-chloroethyltrichlorosilane, p-chloroethyltrichlorosilane, chloromethyl dimethyl chlorosilane, chloromethyl trichlorosilane, p-chlorophenyltrichlorosilane, 3-chloropropyl trichlorosilane, 3-chloropropyl trimethoxysilane, vinyl triethoxysilane, vinyl methoxysilane, vinyl-tris (β-methoxyethoxy) silane, γ-metha-cryloxypropyltrimethoxysilane, vinyl triacetoxysilane, divinyl dichlorosilane, dimethyl vinyl chlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, didecenyldichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyl trimethoxy-silane, hexamethyl disilazane, hexaethyl disilazane, diethyl tetramethyl disilazane, hexaphenyl disilazane, and hexatolyl disilazane. In addition, titanate based coupling agent and aluminum based coupling agent can also be employed.

As the binder resin for use in the present invention, there can be employed conventionally employed binder resins such as homopolymers, copolymers and mixtures thereof, prepared by polymerizing monomers such as styrene, parachlorostyrene, vinyltoluene, vinyl chloride, vinyl acetate, vinyl propionate, methyl (meth)acrylate, ethyl (meth) acrylate, propyl (meth)acrylate, (meth)acrylic acid-n-butyl, isobutyl (meth)acrylate, dodecyl (meth)acrylate, (meth) acrylic acid-2-ethylhexyl, lauryl (meth)acrylate, (meth) acrylic acid-2-hydroxyethyl, hydroxypropyl (meth)acrylate, (meth)acrylic acid-2-chloroethyl, (meth)acrylonitrile, (meth)acrylamide, (meth)acrylic acid, vinyl methyl ether, vinyl ethyl ether, vinyl isobutyl ether, vinyl methyl ketone, N-vinylpyrrolidone, N-vinylpyridine, and butadiene.

In addition, polyester, polyurethane, polyamide, epoxy resin, rosin, modified rosin, terpene resin, phenolic resin, aliphatic or alicyclic hydrocarbon resin, and aromatic petroleum resin can also be employed. These binder resins can be used alone or in combination. Of these binder resins, it is preferable that polyester resin or polyol resin be employed for controlling the dispersed state of the releasing agent.

The following pigments can be employed in the present invention:

Black pigments such as carbon black, oil furnace black, channel black, lamp back, acetylene black, azine dyes such as aniline black, metal salt azo dyes, metallic oxide; composite metallic oxides, and composite metallic oxides.

Yellow pigments such as Cadmium Yellow, Mineral Fast Yellow, Nickel Titan Yellow, Naples Yellow; Naphthol Yellow S, Hansa Yellow G, Hansa Yellow 10G, Benzidine Yellow GR, Quinoline Yellow Lake, Permanent Yellow NCG, Tartrazine Lake, Molybdate Orange, Permanent Orange GTR, Pyrazolone Orange, Vulcan Orange, Indanthrene Brilliant Orange RK, Benzidine Orange G, and Indanthrene Brilliant Orange GK.

Red pigments such as iron oxide red, Cadmium Red, Permanent Red 4R, Lithol Red, Pyrazolone Red, Watchung Red Calcium Salt, Lake Red D, Brilliant Carmine 6B, Eosine Lake, Rhodamine Lake B, Alizarine Lake, and Brilliant Carmine 3B.

Purple pigments such as Fast Violet B and Methyl Violet Lake.

Blue pigments such as Cobalt Blue, Alkali Blue, Victoria Blue Lake, Phthalocyanine Blue, Metal-free Phthalocyanine Blue, Phthalocyanine Blue partially chlorinated, Fast Sky Blue and Indanthrene Blue BC.

Green pigments such as Chrome Green, chromium oxide, Pigment Green B, and Malachite Green Lake.

These pigments can be employed alone or in combination.

Representative examples of the charge controlling agent for use in the present invention are as follows: Nigrosine, azine dyes with an alkyl group having 2 to 16 carbon atoms as disclosed in Japanese Patent Publication No. 42-1627, basic dyes such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1

(C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green. 1 (C.I. 42040), C.I. Basic Green 4 (C.I. 42000), lake pigments of the above basic dyes, C.I. Solvent Black 8 (C.I. 26150), quaternary ammonium salts such as benzoylmethyl-hexadecylammonium chloride, decyl trimethyl chloride, dialkyl tin compounds such as dibutyl and dioctyl tin compounds, dialkyl tin borate compounds, guanidine derivatives, polyamine resins such as amino-group-containing vinyl polymers and amino-group-containing condensation polymers, metal complex salts of monoazo dyes as described in Japanese Patent Publications Nos. 41-20153, 43-27596, 44-6397 and 45-26478, metal complexes such as Zn, Al, Co, Cr and Fe complexes of salicylic acid, dialkyl salicylic acid, naphthoic acid and dicarboxylic acids, and sulfonated copper phthalocyanine pigments.

In the color toners for use in the present invention, it is preferable that the binder resin be in an amount of 75 wt. % to 93 wt. %, the pigment serving as a coloring agent be in an amount of 1.5 wt. % to 10 wt. %, the releasing agent be in an amount of 2 wt. % to 10 wt. %, and other components be in an amount of 1 wt. % to 7 wt. %.

In order to improve the fluidity, development performance, and image transfer performamce of the color toners of the present invention, finely-divided particles of silica, titanium oxide, and alumina, which are subjected to hydrophobic treatment, may be added to each color toner after the color toner is kneaded and pulverized.

In the case where the color toners of the present invention are used as two-component color developers, the color toners are used in combination with a powder-like carrier. As the carrier, there can be used any and all conventionally employed carriers, such as iron powder, ferrite powder, magnetite powder, nickel powder, glass beads, and these powders and beads of which surface is coated with a resin or the like. In the two-component color developers, it is preferable that about 0.5 to 6.0 parts by weight of each color toner be mixed with 100 parts by weight of the carrier.

As a kneading apparatus for kneading the color toners for use in the present invention, the following kneaders can be appropriately employed: a batch-type 2-roll mixer, Banbury's mixer, a continuous double screw extruder such as TMK type double screw extruder made by Kobe Steel, Ltd., TEM type double screw extruder made by Toshiba Machine Co., Ltd., Double screw extruder made by KCK Co., Ltd, PCM type double screw extruder made by Ikegai Tekko Co., Ltd., KEX type double screw extruder made by Kurimoto, Ltd., and a continuous single screw extruder, for example, Continuous Kneader made by Buss Co., Ltd.

The kneaded mixture obtained by any of the above-mentioned kneaders is roughly ground, for instance, using a hammer mill, and then finely pulverized, using a jet mill. It is preferable that an average particle size of the pulverized toner particles be in the range of 3 to 15 $\mu$m. The thus pulverized toner particles are then classified so as to obtain toner particles with a particle size in the range of 5 to 20 $\mu$m, using a pneumatic classifier.

When a multi-color image is formed, using the multi-color toner set of the present invention, each color toner, such as yellow toner, magenta toner, cyan toner, and black toner, may be transferred in any manner, for instance, either by a sequential transfer of each color toner, or by a so-called intermediate transfer method using an intermediate transfer belt.

Other features of this invention will become apparent in the course of the following description of exemplary embodiments, which are given for illustration of the invention and are not intended to be limiting thereof.

EXAMPLE 1

| | Parts by Weight |
|---|---|
| Yellow Toner | |
| Polyester resin | 100 |
| Disazo yellow pigment (C.I. Pigment Yellow 17) | 5 |
| Chromium-containing azo pigment | 2 |
| Low-molecular-weight polyethylene (m.p. 83° C.) serving as releasing agent | 11.3 |
| Magenta Toner | |
| Polyester resin | 100 |
| Quinacridone magenta pigment (C.I. Pigment Red 122) | 4 |
| Chromium-containing azo pigment | 2 |
| Low-molecular-weight polyethylene (m.p. 83° C.) serving as releasing agent | 9.6 |
| Cyan Toner | |
| Polyester resin | 100 |
| Copper phthalocyanine blue (C.I. Pigment Blue 15) | 2 |
| Chromium-containing azo pigment | 2 |
| Low-molecular-weight polyethylene (m.p. 83° C.) serving as releasing agent | 8.2 |
| Black Toner | |
| Polyester resin | 100 |
| Carbon Black ("C.44", made by Mitsubishi Chemical Corporation) | 6 |
| Chromium-containing azo pigment | 2 |
| Low-molecular-weight polyethylene (m.p. 83° C.) serving as releasing agent | 11.8 |

For preparing a yellow toner, a magenta toner, a cyan toner, and a black toner for use in the present invention, a mixture of the above components with the above formulation for each color toner was sufficiently mixed separately in a blender, and was then kneaded at 120° C. in a double screw extruder.

Each of the above kneaded mixtures was cooled by roll milling, roughly ground in a cutter mill, pulverized, using a jet mill, and then classified, using a pneumatic classifier, whereby colored matrix particles for each color toner were obtained.

100 parts by weight of the colored matrix particles for each color toner and 0.5 parts by weight of hydrophobic silica were mixed in Henschel mixer, whereby a yellow toner, a magenta toner, a cyan toner and a black toner for use in the present invention were obtained.

TABLE 1 shows a volume mean diameter ($\mu$m) of the toner particles of each color toner, the content of the releasing agent in State Mode 3 in terms of the ratio (%) of the cross section of the domains, and a maximum length ($\mu$m) of the dispersed releasing agent particles in the domains. In TABLE 1, the difference in the content of the releasing agent in the form of domains in the binder agent can be obtained by the following formula as mentioned above:

Difference in the content of Releasing Agent={(Maximum Content−Minimum Content)/Average Content}×100%.

TABLE 1

| | Volume Mean Diameter (μm) of Color Toner Particles | Content of Releasing Agent in State Mode 3 in terms of Ratio (%) of Cross Section of Domains | Maximum Length (μm) of Dispersed Releasing Agent Particles in Domains |
|---|---|---|---|
| Yellow Toner | 7.5 | 5.8 | 2.1 |
| Magenta Toner | 7.6 | 6.0 | 2.3 |
| Cyan Toner | 7.4 | 6.4 | 2.5 |
| Black Toner | 7.3 | 5.8 | 2.2 |
| Difference in the content of Releasing agent | | 10.0 | |

The volume mean diameter (μm) of the toner particles of each color toner was measured, using Coulter Counter Model TA-II made by Coulter Electronics Co., Ltd.

The content of the releasing agent in State Mode 3 was determined in terms of the ratio of the cross section of the domains to the cross section of each toner particle, by an image analysis using a transmission type electron microscope, and the maximum length (μm) of the dispersed releasing agent in the domains was determined by dissolving about 20 mg of each color toner in about 0.2 g of THF, and inspecting the mixture in an undried state by an optical microscope with a magnification of 500 times.

5 parts by weight of each color toner were mixed with 100 parts by weight of a carrier composed of ferrite particles with an average particle size of 50 μm, the surface of which ferrite particles were coated with a silicone resin, whereby a yellow developer, a magenta developer, a cyan developer and a black developer were prepared.

The thus prepared color developers were set in a commercially available copying machine (Trademark "Preter 550" made by Ricoh Company, Ltd.), and a 100,000 copies making running test was conducted, without applying any image fixing oil to an image fixing unit thereof, whereby the anti-offset performance, durability and image transfer performance for each color toner were inspected and evaluated. The results are shown in TABLE 15.

In this 100,000 copies making running test, the anti-offset performance was evaluated by measuring the offset initiation temperature, the durability was evaluated by measuring the change in charge quantity of each developer in the course of the running test, making the first copy to the 100,000th copy, and the image transfer performance was evaluated by assessing the image transfer ratio from the amount of the toner consumed when 100,000 copies were made and the amount of the toner recovered at a cleaning unit of the copying machine.

The variations in the above evaluated properties between each color toner were assessed by calculating the difference between the maximum value and the minimum value with respect to each property as shown in TABLE 15.

EXAMPLE 2

The procedure of preparing the yellow toner, the magenta toner, the cyan toner, and the black toner for use in the present invention in Example 1 was repeated except that the amount of the low-molecular-weight polyethylene (m.p. 83° C.) used as the releasing agent for each color toner was changed as shown in the following

TABLE 2

| | Releasing Agent | |
|---|---|---|
| | Material | Amount (parts by weight) |
| Yellow Toner | Low-molecular-weight polyethylene (m.p. 83° C.) | 8.3 |
| Magenta Toner | | 6.6 |
| Cyan Toner | | 5.2 |
| Black Toner | | 8.8 |

Thus, a yellow toner, a magenta toner, a cyan toner, and a black toner with the properties as shown in the following TABLE 3 were prepared:

TABLE 3

| | Volume Mean Diameter (μm) of Color Toner Particles | Content of Releasing Agent in State Mode 3 in terms of Ratio (%) of Cross Section of Domains | Maximum Length (μm) of Dispersed Releasing Agent Particles in Domains |
|---|---|---|---|
| Yellow Toner | 7.4 | 2.8 | 1.1 |
| Magenta Toner | 7.5 | 3.0 | 1.3 |
| Cyan Toner | 7.6 | 3.4 | 1.5 |
| Black Toner | 7.3 | 2.8 | 1.1 |
| Difference in the content of Releasing agent | | 19.0 | |

Furthermore, a yellow developer, a magenta developer, a cyan developer and a black developer were prepared in the same manner as in Example 1 except that each color toner used in Example 1 was replaced by the above prepared yellow toner, magenta toner, cyan toner, and black toner, and were evaluated in the same manner as in Example 1 by carrying out the same 100,000 copies making running test as in Example 1.

The results of the running test are shown in TABLE 15.

EXAMPLE 3

The procedure of preparing the yellow toner, the magenta toner, the cyan toner, and the black toner for use in the present invention in Example 1 was repeated except that the amount of the low-molecular-weight polyethylene (m.p. 83° C.) used as the releasing agent for each color toner was changed as shown in the following TABLE 4, and that the keading temperature was lowered to 105° C.

TABLE 4

| | Releasing Agent | |
|---|---|---|
| | Material | Amount (parts by weight) |
| Yellow Toner | Low-molecular-weight polyethylene (m.p. 83° C.) | 8.3 |
| Magenta Toner | | 6.6 |
| Cyan Toner | | 4.8 |
| Black Toner | | 8.8 |

Thus, a yellow toner, a magenta toner, a cyan toner, and a black toner with the properties as shown in the following TABLE 5 were prepared:

TABLE 5

| | Volume Mean Diameter (μm) of Color Toner Particles | Content of Releasing Agent in State Mode 3 in terms of Ratio (%) of Cross Section of Domains | Maximum Length (μm) of Dispersed Releasing Agent Particles in Domains |
|---|---|---|---|
| Yellow Toner | 7.5 | 2.8 | 0.8 |
| Magenta Toner | 7.6 | 3.0 | 0.9 |
| Cyan Toner | 7.4 | 3.0 | 1.0 |
| Black Toner | 7.5 | 2.8 | 0.8 |
| Difference in the content of Releasing agent | | 7.0 | |

Furthermore, a yellow developer, a magenta developer, a cyan developer and a black developer were prepared in the same manner as in Example 1 except that each color toner used in Example 1 was replaced by the above prepared yellow toner, magenta toner, cyan toner, and black toner, and were evaluated in the same manner as in Example 1 by carrying out the same 100,000 copies making running test as in Example 1.

The results of the running test are shown in TABLE 15.

EXAMPLE 4

The procedure of preparing the yellow toner, the magenta toner, the cyan toner, and the black toner for use in the present invention in Example 3 was repeated except that the low-molecular-weight polyethylene (m.p. 83° C.) used as the releasing agent for each color toner was replaced by a combination of a releasing agent 1 and a releasing agent 2 as shown in the following TABLE 6.

TABLE 6

| | Releasing Agent 1 (with High Melting Point) | | Releasing Agent 2 (with Low Melting Point) | |
|---|---|---|---|---|
| | Material | Amount (parts by weight) | Material | Amount (parts by weight) |
| Yellow Toner | Low-molecular-weight polyethylene (m.p. 83° C.) | 2.8 | Carnauba wax (m.p. 81° C.) | 5.3 |
| Magenta Toner | | 3.0 | | 3.4 |
| Cyan Toner | | 3.0 | | 1.6 |

TABLE 6-continued

| | Releasing Agent 1 (with High Melting Point) | | Releasing Agent 2 (with Low Melting Point) | |
|---|---|---|---|---|
| | Material | Amount (parts by weight) | Material | Amount (parts by weight) |
| Toner | | | | |
| Black Toner | | 2.8 | | 5.8 |

Thus, a yellow toner, a magenta toner, a cyan toner, and a black toner with the properties as shown in the following TABLE 7 were prepared:

TABLE 7

| | Volume Mean Diameter (μm) of Color Toner Particles | Content of Releasing Agent in State Mode 3 in terms of Ratio (%) of Cross Section of Domains | Maximum Length (μm) of Dispersed Releasing Agent Particles in Domains |
|---|---|---|---|
| Yellow Toner | 7.4 | 2.7 | 0.7 |
| Magenta Toner | 7.6 | 2.9 | 0.8 |
| Cyan Toner | 7.4 | 2.9 | 0.9 |
| Black Toner | 7.5 | 2.6 | 0.7 |
| Difference in the content of Releasing agent | | 11.0 | |

Furthermore, a yellow developer, a magenta developer, a cyan developer and a black developer were prepared in the same manner as in Example 3 except that each color toner used in Example 3 was replaced by the above prepared yellow toner, magenta toner, cyan toner, and black toner, and were evaluated in the same manner as in Example 3 by carrying out the same 100,000 copies making running test as in Example 3.

The results of the running test are shown in TABLE 15.

EXAMPLE 5

The procedure of preparing the yellow toner, the magenta toner, the cyan toner, and the black toner for use in the present invention in Example 3 was repeated except that the amount of the low-molecular-weight polyethylene (m.p. 83° C.) used as the releasing agent for each color toner was changed as shown in the following TABLE 8 and that finely-divided particles of metallic oxide, specifically hydrophobic silica, were added thereto with the formulation as shown in TABLE 8.

TABLE 8

| | Releasing Agent | | Finely-divided Particles of Metallic Oxide | |
|---|---|---|---|---|
| | Material | Amount (parts by weight) | Material | Amount (parts by weight) |
| Yellow Toner | Low-molecular-weight polyethylene (m.p. 83° C.) | 9.0 | Hydrophobic Silica (made by Nippon Aerosil Co., Ltd.) | 0.7 |
| Magenta Toner | | 9.0 | | 2.5 |
| Cyan Toner | | 9.0 | | 4.2 |

TABLE 8-continued

| | Releasing Agent | | Finely-divided Particles of Metallic Oxide | |
|---|---|---|---|---|
| | Material | Amount (parts by weight) | Material | Amount (parts by weight) |
| Toner | | | | |
| Black Toner | | 9.0 | | 0.2 |

Thus, a yellow toner, a magenta toner, a cyan toner, and a black toner with the properties as shown in the following TABLE 9 were prepared:

TABLE 9

| | Volume Mean Diameter (μm) of Color Toner Particles | Content of Releasing Agent in State Mode 3 in terms of Ratio (%) of Cross Section of Domains | Maximum Length (μm) of Dispersed Releasing Agent Particles in Domains |
|---|---|---|---|
| Yellow Toner | 7.5 | 2.8 | 0.8 |
| Magenta Toner | 7.5 | 2.9 | 0.8 |
| Cyan Toner | 7.6 | 3.0 | 1.0 |
| Black Toner | 7.5 | 2.8 | 0.8 |
| Difference in the content of Releasing agent | | 7.0 | |

Furthermore, a yellow developer, a magenta developer, a cyan developer and a black developer were prepared in the same manner as in Example 3 except that each color toner used in Example 3 was replaced by the above prepared yellow toner, magenta toner, cyan toner, and black toner, and were evaluated in the same manner as in Example 3 by carrying out the same 100,000 copies making running test as in Example 3.

The results of the running test are shown in TABLE 15.

EXAMPLE 6

A yellow toner, a magenta toner, a cyan toner and a black toner with the properties as shown in the following TABLE 10 were prepared, using the same materials as used in Example 6, by the steps of mixing the pigment, the hydrophobic silica and the releasing agent in a mixer, then placing the mixture at 100° C. for 30 minutes in a thermostat to prepare a kneaded composition in which the releasing agent was absorbed by the pigment and/or the hydrohobic silica, and mixing the kneaded composition with the other components for each color toner in a mixer:

TABLE 10

| | Volume Mean Diameter (μm) of Color Toner Particles | Content of Releasing Agent in State Mode 3 in terms of Ratio (%) of Cross Section of Domains | Maximum Length (μm) of Dispersed Releasing Agent Particles in Domains |
|---|---|---|---|
| Yellow Toner | 7.5 | 2.8 | 0.8 |
| Magenta Toner | 7.4 | 2.8 | 0.8 |
| Cyan Toner | 7.6 | 2.8 | 0.8 |

TABLE 10-continued

| | Volume Mean Diameter (μm) of Color Toner Particles | Content of Releasing Agent in State Mode 3 in terms of Ratio (%) of Cross Section of Domains | Maximum Length (μm) of Dispersed Releasing Agent Particles in Domains |
|---|---|---|---|
| Black Toner | 7.5 | 2.8 | 0.8 |
| Difference in the content of Releasing agent | | 0.0 | |

Furthermore, a yellow developer, a magenta developer, a cyan developer and a black developer were prepared in the same manner as in Example 3 except that each color toner used in Example 3 was replaced by the above prepared yellow toner, magenta toner, cyan toner, and black toner, and were evaluated in the same manner as in Example 3 by carrying out the same 100,000 copies making running test as in Example 3.

The results of the running test are shown in TABLE 15.

Comparative Example 1

The procedure of preparing the yellow toner, the magenta toner, the cyan toner, and the black toner for use in the present invention in Example 1 was repeated except that the amount of the low-molecular-weight polyethylene (m.p. 83° C.) used as the releasing agent for each color toner was changed as shown in the following TABLE 11:

TABLE 11

| | Releasing Agent | |
|---|---|---|
| | Material | Amount (parts by weight) |
| Yellow Toner | Low-molecular-weight polyethylene (m.p. 83° C.) | 9.0 |
| Magenta Toner | | 9.0 |
| Cyan Toner | | 9.0 |
| Black Toner | | 9.0 |

Thus, a yellow toner, a magenta toner, a cyan toner, and a black toner with the properties as shown in the following TABLE 12 were prepared:

TABLE 12

| | Volume Mean Diameter (μm) of Color Toner Particles | Content of Releasing Agent in State Mode 3 in terms of Ratio (%) of Cross Section of Domains | Maximum Length (μm) of Dispersed Releasing Agent Particles in Domains |
|---|---|---|---|
| Yellow Toner | 7.6 | 3.5 | 2.0 |
| Magenta Toner | 7.5 | 5.4 | 3.3 |
| Cyan Toner | 7.4 | 7.2 | 5.1 |
| Black Toner | 7.4 | 3.0 | 1.8 |
| Difference in the content of Releasing agent | | 88.0 | |

Furthermore, a yellow developer, a magenta developer, a cyan developer and a black developer were prepared in the same manner as in Example 1 except that each color toner used in Example 1 was replaced by the above prepared yellow toner, magenta toner, cyan toner, and black toner, and were evaluated in the same manner as in Example 1 by carrying out the same 100,000 copies making running test as in Example 1.

The results of the running test are shown in TABLE 15. As indicated in TABLE 15, the properties of each color toner differed. In particular, the cyan toner was considerably poor in the anti-offset performance, durability, and image transfer ratio, and did not reach standard values necessary for use in practice.

Comparative Example 2

The procedure of preparing the yellow toner, the magenta toner, the cyan toner, and the black toner for use in the present invention in Example 1 was repeated except that the amount of the low-molecular-weight polyethylene (m.p. 83° C.) used as the releasing agent for each color toner was changed as shown in the following TABLE 13:

TABLE 13

| | Releasing Agent | |
|---|---|---|
| | Material | Amount (parts by weight) |
| Yellow Toner | Low-molecular-weight polyethylene (m.p. 83° C.) | 6.0 |
| Magenta Toner | | 6.0 |
| Cyan Toner | | 6.0 |
| Black Toner | | 6.0 |

Thus, a yellow toner, a magenta toner, a cyan toner, and a black toner with the properties as shown in the following TABLE 14 were prepared:

TABLE 14

| | Volume Mean Diameter (μm) of Color Toner Particles | Content of Releasing Agent in State Mode 3 in terms of Ratio (%) of Cross Section of Domains | Maximum Length (μm) of Dispersed Releasing Agent Particles in Domains |
|---|---|---|---|
| Yellow Toner | 7.4 | 0.5 | 0.6 |
| Magenta Toner | 7.6 | 2.4 | 0.8 |
| Cyan Toner | 7.4 | 4.2 | 3.0 |
| Black Toner | 7.5 | 0.2 | 0.5 |
| Difference in the content of Releasing agent | | 219 | |

Furthermore, a yellow developer, a magenta developer, a cyan developer and a black developer were prepared in the same manner as in Example 1 except that each color toner used in Example 1 was replaced by the above prepared yellow toner, magenta toner, cyan toner, and black toner, and were evaluated in the same manner as in Example 1 by carrying out the same 100,000 copies making running test as in Example 1.

The results of the running test are shown in TABLE 15. As indicated in TABLE 15, the properties of each color toner considerably differed. In particular, the yellow toner and the black toner exhibited excellent durability and image transfer ratio, but the ant-offset performance and releasbility thereof were extremely poor.

TABLE 15

| | | Offset Initiation Temperature (° C.) | Difference in Offset Initiation Temperature (° C.) (Max. - Min.) | Image Transfer Ratio (%) | Difference in Image Transfer Ratio (%) (Max. - Min.) between Each Color Toner | Durability (Change in charge quantity during the 100,000 copies making test) | Difference in Durability (Max. - Min.) |
|---|---|---|---|---|---|---|---|
| Ex. 1 | Yellow Toner | 195 | 0 | 88 | 1 | 2.0 | 0.1 |
| | Magenta Toner | 195 | | 87 | | 1.9 | |
| | Cyan Toner | 195 | | 88 | | 1.8 | |
| | Black Toner | 195 | | 88 | | 1.8 | |
| Ex. 2 | Yellow Toner | 185 | 0 | 90 | 1 | 1.5 | 0.5 |
| | Magenta Toner | 185 | | 91 | | 1.3 | |
| | Cyan Toner | 185 | | 90 | | 1.4 | |
| | Black Toner | 185 | | 91 | | 1.0 | |
| Ex. 3 | Yellow Toner | 185 | 0 | 92 | 1 | 1.1 | 1.1 |
| | Magenta Toner | 185 | | 91 | | 0.0 | |
| | Cyan Toner | 185 | | 91 | | 0.0 | |
| | Black Toner | 185 | | 92 | | 0.0 | |
| Ex. 4 | Yellow Toner | 185 | 0 | 92 | 0 | 0.5 | 0.2 |
| | Magenta Toner | 185 | | 92 | | 0.5 | |

TABLE 15-continued

| | | Offset Initiation Temperature (° C.) | Difference in Offset Initiation Temperature (° C.) (Max. - Min.) | Image Transfer Ratio (%) | Difference in Image Transfer Ratio (%) (Max. - Min.) between Each Color Toner | Durability (Change in charge quantity during the 100,000 copies making test) | Difference in Durability (Max. - Min.) |
|---|---|---|---|---|---|---|---|
| | Cyan Toner | 185 | | 92 | | 0.5 | |
| | Black Toner | 185 | | 92 | | 0.3 | |
| Ex. 5 | Yellow Toner | 185 | 0 | 92 | 0 | 0.5 | 0.2 |
| | Magenta Toner | 185 | | 92 | | 0.5 | |
| | Cyan Toner | 185 | | 92 | | 0.7 | |
| | Black Toner | 185 | | 92 | | 0.6 | |
| Ex. 6 | Yellow Toner | 185 | 0 | 92 | 0 | 0.5 | 0.1 |
| | Magenta Toner | 185 | | 92 | | 0.4 | |
| | Cyan Toner | 185 | | 92 | | 0.4 | |
| | Black Toner | 185 | | 92 | | 0.5 | |
| Comp. Ex. 1 | Yellow Toner | 185 | 15 | 88 | 20 | 1.6 | 6.4 |
| | Magenta Toner | 195 | | 85 | | 3.5 | |
| | Cyan Toner | 200 | | 70 | | 7.9 | |
| | Black Toner | 185 | | 90 | | 1.5 | |
| Comp. Ex. 2 | Yellow Toner | 150 | 40 | 94 | 6 | 0.2 | 3.6 |
| | Magenta Toner | 185 | | 90 | | 0.5 | |
| | Cyan Toner | 190 | | 88 | | 3.8 | |
| | Black Toner | 140 | | 94 | | 0.2 | |

What is claimed is:

1. A multi-color toner set comprising a plurality of color toners with different colors, each color tone r comprising toner particles, each toner particle comprising a binder resin, a pigment and a releasing agent, at least of said releasing agent being present in the form of domains in said binder resin, with a difference between a maximum content and a minimum content of said releasing agent in the form of domains in said binder resin in each of said color toners being in a range of 20% or less.

2. The multi-color toner set as claimed in claim 1, wherein the amount of said releasing agent in each of said color toners is in a range of 2 to 10 wt. % of the entire weight of each of said color toners, and a ratio of a total content of said releasing agent which is present in the form of domains in said binder resin is in a range of 2 to 7% in each of said color toners.

3. The multi-color toner set as claimed in claim 1, wherein at least 75% of a total number of said domains of said releasing agent in said binder resin in each particle of each of said color toners has a maximum length of 1 $\mu$m or less.

4. The multi-color toner set as claimed in claim 2, wherein at least 75% of a total number of said domains of said releasing agent in said binder resin in each particle of each of said color toners has a maximum length of 1 $\mu$m or less.

5. The multi-color toner set as claimed in claim 1, wherein said releasing agent comprises a first releasing agent with a melting point T1 and a second releasing agent with a melting point T2 which is lower than said melting point T1 of said first releasing agent, and in said releasing agent which is present in the form of domains in said binder resin, the amount of said first releasing agent is greater than that of said second releasing agent.

6. The multi-color toner set as claimed in claim 2, wherein said releasing agent comprises a first releasing agent with a melting point T1 and a second releasing agent with a melting point T2 which is lower than said melting point T1 of said first releasing agent, and in said releasing agent which is present in the form of domains in said binder resin, the amount of said first releasing agent is greater than that of said second releasing agent.

7. The multi-color toner set as claimed in claim 1, wherein each of said particles of said toners further comprises finely-divided particles which are incompatible with said binder resin in each of said particles of said toners.

8. The multi-color toner set as claimed in claim 1, wherein said binder resin in each of said color toners is selected from the group consisting of polyester resin and polyol resin.

9. The multi-color toner set as claimed in claim 2, wherein said binder resin in each of said color toners is selected from the group consisting of polyester resin and polyol resin.

10. The multi-color toner set as claimed in claim 1, wherein said plurality of color toners comprises a yellow toner, a magenta toner, a cyan toner, and a black toner.

11. A method of forming a multi-color image, using a multi-color toner set comprising a plurality of color toners with different colors, each color toner comprising toner particles, each toner particle comprising a binder resin, a pigment and a releasing agent, at least part of said releasing agent being present in the form of domains in said binder resin, with a difference between a maximum content and a minimum content of said releasing agent in the form of domains in said binder resin in each of said color toners being in a range of 20% or less.

12. The method of forming a multi-color image as claimed in claim 11, wherein the amount of said releasing agent in each of said color toners is in a range of 2 to 10 wt. % of the entire weight of each of said color toners, and a ratio of a total content of said releasing agent which is present in the form of domains in said binder resin is in a range of 2 to 7% in each of said color toners.

13. The method of forming a multi-color image as claimed in claim 11, wherein at least 75% of a total number of said domains of said releasing agent in said binder resin in each particle of each of said color toners has a maximum length of 1 $\mu$m or less.

14. The method of forming a multi-color image as claimed in claim 12, wherein at least 75% of a total number of said domains of said releasing agent in said binder resin in each particle of each of said color toners has a maximum length of 1 $\mu$m or less.

15. The method of forming a multi-color image as claimed in claim 11, wherein said releasing agent comprises a first releasing agent with a melting point T1 and a second releasing agent with a melting point T2 which is lower than said melting point T1 of said first releasing agent, and in said releasing agent which is present in the form of domains in said binder resin, the amount of said first releasing agent is greater than that of said second releasing agent.

16. The method of forming a multi-color image as claimed in claim 12, wherein said releasing agent comprises a first releasing agent with a melting point T1 and a second releasing agent with a melting point T2 which is lower than said melting point T1 of said first releasing agent, and in said releasing agent which is present in the form of domains in said binder resin, the amount of said first releasing agent is greater than that of said second releasing agent.

17. The method of forming a multi-color image as claimed in claim 11, wherein each of said particles of said toners further comprises finely-divided particles which are incompatible with said binder resin in each of said particles of said toners.

18. The method of forming a multi-color image as claimed in claim 11, wherein said binder resin in each of said color toners is selected from the group consisting of polyester resin and polyol resin.

19. The method of forming a multi-color image as claimed in claim 12, wherein said binder resin in each of said color toners is selected from the group consisting of polyester resin an polyol resin.

20. The method of forming a multi-color image as claimed in claim 11, wherein said plurality of color toners comprises a yellow toner, a magenta toner, a cyan toner, and a black toner.

21. The multi-color toner set as claimed in claim 5, wherein said first releasing agent is a low molecular weight polyethylene and said second releasing agent is carnuba wax.

22. The multi-color toner set as claimed in claim 6, wherein said first releasing agent is a low molecular weight polyethylene and said second releasing agent is carnuba wax.

23. The multi-color toner set as claimed in claim 7, wherein said releasing agent is a low molecular weight polyethylene and said finely divided particles are particles of hydrophobic silica.

* * * * *

UNITED STATES PATENT AND TRADEMARK OFFICE

CERTIFICATE OF CORRECTION

PATENT NO. : 6,180,298 B1
DATED : January 30, 2001
INVENTOR(S) : Noboru Kuroda et al.

It is certified that error appears in the above-identified patent and that said Letters Patent is hereby corrected as shown below:

Column 2,
Line 37, “3000 Å”, should read -- 3000Å --.
Line 41, “500 Å”, should read -- 5000Å --.
Line 52, “Spvalue”, should read -- SP value --.

Column 6,
Line 46, “agent. in”, should read -- agent. In --.

Column 12,
Line 7, “the following”, should read -- the following TABLE 2: --.

Column 18,
Line 32, “ant-offset”, should read -- anti-offset --.

Column 19,
Line 43, “tone r”, should read -- toner --.
Line 45, “at least of said”, should read -- at least part of said --.

Signed and Sealed this

Twenty-first Day of June, 2005

JON W. DUDAS
*Director of the United States Patent and Trademark Office*